US011761228B2

(12) United States Patent
Long

(10) Patent No.: US 11,761,228 B2
(45) Date of Patent: Sep. 19, 2023

(54) FAN-SHAPED TENT SKELETON AND FAN-SHAPED TENT

(71) Applicant: Lonman Auto Accessories Co., Ltd, Dongguan (CN)

(72) Inventor: Shihu Long, Dongguan (CN)

( * ) Notice: Subject to any disclaimer, the term of this patent is extended or adjusted under 35 U.S.C. 154(b) by 39 days.

(21) Appl. No.: 17/241,102

(22) Filed: Apr. 27, 2021

(65) Prior Publication Data

US 2022/0341208 A1 Oct. 27, 2022

(51) Int. Cl.

| | |
|---|---|
| ***E04H 15/46*** | (2006.01) |
| ***E04H 15/06*** | (2006.01) |
| ***E04H 15/38*** | (2006.01) |
| *E04H 15/42* | (2006.01) |

(52) U.S. Cl.
CPC ..... *E04H 15/46* (2013.01); *E04H 15/06* (2013.01); *E04H 15/38* (2013.01); *E04H 15/42* (2013.01)

(58) Field of Classification Search
CPC ..... E04H 15/06; E04H 15/38
See application file for complete search history.

(56) References Cited

U.S. PATENT DOCUMENTS

| | | | | | |
|---|---|---|---|---|---|
| D622,413 | S | * | 8/2010 | Cropley | D25/56 |
| D622,414 | S | * | 8/2010 | Cropley | D25/56 |
| D698,941 | S | * | 2/2014 | Cropley | D25/56 |
| D870,318 | S | * | 12/2019 | Everett | D12/403 |
| 2020/0141151 | A1 | * | 5/2020 | Everett | E04F 10/04 |
| 2020/0384836 | A1 | * | 12/2020 | Pearce | B60J 7/12 |

FOREIGN PATENT DOCUMENTS

| | | | | | |
|---|---|---|---|---|---|
| AU | 2010100817 | A4 | * | 9/2010 | E04F 10/04 |
| AU | 2010202982 | A1 | * | 2/2011 | B60J 11/02 |
| CN | 105735740 | A | * | 7/2016 | |
| CN | 205422133 | U | * | 8/2016 | |
| CN | 205857895 | U | * | 1/2017 | |
| CN | 211342055 | U | * | 8/2020 | |
| CN | 213449757 | U | * | 6/2021 | |
| WO | WO-2017032828 | A1 | * | 3/2017 | E04F 10/04 |
| WO | WO-2021035685 | A1 | * | 3/2021 | |

* cited by examiner

*Primary Examiner* — David R Dunn
*Assistant Examiner* — Danielle Jackson

(57) ABSTRACT

A fan-shaped tent skeleton and a fan-shaped tent are provided. The fan-shaped tent skeleton comprises a base plate, wherein the base plate is arranged laterally, rotary rod assemblies are arranged on upper and lower sides of a first end of the base plate, each of the rotary rod assemblies comprises a fixed seat fixed to the base plate, two rotary rods are hinged to the fixed seat, the two rotary rods are a front rotary rod and a back rotary rod, the front rotary rod and the back rotary rod are connected to a front hinge shaft and a back hinge shaft and are connected to the fixed seat through the front hinge shaft and the back hinge shaft, and a first connecting structure for connecting a fan-shaped tent fabric is arranged at a second end of the base plate.

9 Claims, 7 Drawing Sheets

FAN-SHAPED TENT SKELETON AND FAN-SHAPED TENT

TECHNICAL FIELD

The disclosure relates to the technical field of tents and in particular relates to a fan-shaped tent skeleton and a fan-shaped tent.

BACKGROUND

With social development, going out for travel by driving vehicles has become more and more popular. In a process of going out for travel by driving vehicles, people may have a rest once in a while. In order to shield sunlight for rest, many fan-shaped tents have emerged in the present market, these fan-shaped tents are complex in structure and it is troublesome to mount and detach the fan-shaped tents. As midway stop is just for short-time rest, if the fan-shaped tent of a complex structure is used, the time is wasted and it is inconvenient to use the fan-shaped tent.

SUMMARY

Aiming to overcome defects in the prior art, the disclosure provides a fan-shaped tent skeleton. The fan-shaped tent skeleton is matched with a roof rack in use. It is unnecessary to disassemble and assemble the tent and it is convenient to use the tent.

The disclosure further aims to provide a fan-shaped tent. The tent is provided with the fan-shaped tent skeleton.

A fan-shaped tent skeleton includes a laterally arranged base plate, wherein a rotary rod assembly is arranged at one end of the base plate and includes at least three rotary rods, and each rotary rod includes n upper rotary rods and/or m lower rotary rods; the upper rotary rods or/and the lower rotary rods are rotatably connected to the base plate and can rotate relative to the base plate, separately; when n is greater than 1 and the upper rotary rods rotate till the length directions of the upper rotary rods are parallel to the length direction of the base plate, adjacent two upper rotary rods are abutted; and when m is greater than 1 and the lower rotary rods rotate till the length directions of the lower rotary rods are parallel to the length direction of the base plate, adjacent two lower rotary rods are abutted.

According to the technical scheme, as the plurality of rotary rods are arranged at one end of the base plate, during use, the plurality of rotary rods are unfolded relative to the base plate, like a folding fan is opened to form a fan-shaped tent skeleton. The rotary rods can be either upper rotary rods or lower rotary rods or upper rotary rods and lower rotary rods which are matched, such that more than three rotary rods are arranged in order to optimize support of the tent skeleton and making a coverage area large. When the tent skeleton is unfolded, an included angle between the adjacent two rotary rods is approximately 90 degrees.

Further, the rotary rod assembly further includes a fixed seat fixed to the base plate. The fixed seat includes a bottom plate fixedly connected to the bottom plate. An upper side plate and a lower side plate are separately arranged on the upper and lower sides of the bottom plate, s fixed shafts and t external movable shafts are arranged between the upper side plate and the lower side plate, s is smaller value in m and n, t is a difference value between m and n; when t is greater than 0 and m is greater than n, the n upper rotary shafts and the n lower rotary shafts are hinged to n fixed shafts in a one-to-one correspondence manner, connecting pieces are separately arranged between two sides of the lower rotary rod hinged to the fixed shaft farthest from the base plate, one ends of the two connecting pieces are hinged to the fixed shaft, t external movable shafts are arranged between the two connecting pieces, and the t external movable shafts and residual t lower rotary rods are hinged in a one-to-one correspondence manner; when t is greater than 0 and n is greater than m, m upper rotary shafts and n rotary shafts are hinged to m fixed shafts in a one-to-one correspondence manner, the connecting pieces are separately arranged on two sides of the upper rotary rod hinged to the fixed shaft farthest from the base plate, one ends of the two connecting pieces are hinged to the fixed shaft, separately, the t external movable shafts are arranged between the two connecting pieces and the t external movable shafts are hinged to the residual t upper rotary rods in a one-to-one correspondence manner.

When the technical scheme is implemented, in order to rotatably connect the upper rotary rods and the lower rotary rods to the bases plate conveniently, the fixed seat is designed. Shaft holes are formed in the end portions of the upper and lower rotary rods. When the upper and lower rotary rods are same in quantity, the smaller value between m and n can be either m or n. S fixed shafts are hinged to the upper and lower rotary rods in a one-to-one correspondence manner directly, i.e. one fixed shaft is hinged to one upper rotary rod and one lower rotary rod simultaneously. When m and n are not equal, the two connecting pieces are arranged to be hinged with the fixed shaft, and the residual upper and lower rotary rods that are paired are hinged to the external movable shafts.

Further, the rotary rod assembly further includes an upper fixed seat and a lower fixed seat fixed to the base plate, each of the upper and lower fixed seats includes two oppositely arranged fixed sheets, the upper fixed seat is hinged to the m upper rotary rods through m upper hinge shafts, separately, and the lower fixed seat is hinged to the n lower rotary rods through n hinge shafts.

In order to rotatably connect the upper rotary rods and the lower rotary rods to the base plate, the upper fixed seat, the lower fixed seat and upper hinge shafts are arranged on the base plate according to the technical scheme. The n upper hinge shafts are separately fixed between the two fixed pieces of the upper fixed seat in a spaced manner, and the m lower hinge shafts are separately fixed between two fixed pieces of the lower fixed seat in a spaced manner. Second, in view of rotating angles of the upper and lower rotary rods which may exceed 180 degrees, the outer end portions of the two fixed pieces of the upper fixed seat or the lower fixed seat extend along the length direction of the base plate and stretch out of the base plate.

A fan-shaped tent skeleton includes a laterally arranged base plate, wherein rotary rod assemblies are arranged on the upper and lower sides of one end of the base plate, each of the rotary rod assemblies includes a fixed seat fixed to the base plate, one or at least two rotary rods are rotatably connected to the fixed seat, the total number of the rotary rods is not smaller than 3, when the two rotary rods are rotatably connected to the fixed seat, the two rotary rods are the front rotary rod and the back rotary rod separately, and the front rotary rod and the back rotary rod are separately connected to the front hinge shaft and the back hinge shaft and are connected to the fixed seat through the front hinge shaft and the back hinge shaft separately.

According to the technical scheme, when the fan-shaped tent skeleton works, the base plate can be directly fixed to the roof rack. The rotary rods rotate relative to the fixed seat to be unfolded, the adjacent two rotary rods form an included angle, the rotary rod close to the base plate and the base plate form an included angle, and the base plate and all the rotary rods form a bracket for supporting a tent fabric, wherein the base plate and the rotary rods that are maximum in rotating angle after being unfolded form two edges of the fan-shaped tent. When the tent skeleton is not used, it is necessary to rotate the rotary rods relative to the fixed seat to be close to the fixed plate and then bundle the rotary rods and the fixed seat together with a bundling belt or a bandage.

Further, when one fixed seat is hinged to one rotary rod, the rotary rod is an auxiliary rotary rod and the other end of the base plate is provided with the rotary rod assembly. The fixed seat of the rotary rod assembly is hinged to one rotary rod, and the rotary rod is a main rotary rod. The main rotary rod and the auxiliary rotary rod are located at a same height. When the fan-shaped tent skeleton is folded, the main rotary rod and the auxiliary rotary rod are abutted in parallel.

When the fan-shaped tent is used, it is needed to use the roof rack and the vehicle body. In the tent using process, matched with the vehicle body, increase of an overshadowing range of the tent is a preferred choice. According to the technical scheme, the rotary rod assembly is arranged at the other end of the base plate, the rotary rod assembly is provided with one main rotary rod, the main rotary rod which is unfolded is substantially vertical to the base plate, and meanwhile, the end portion of the main rotary rod is connected to the front end of the vehicle body through a pull rope, so that the main rotary rod is kept in an unfolded state. Second, the main rotary rod can be connected to a side tent fabric, and the side tent fabric is fixed to the ground through the pull rope to form a wind wall.

In order to fold the rotary rods, limitations have been made to the main rotary rod and the auxiliary rotary rod according to the technical scheme, so that when the tent skeleton is folded, the main rotary rod and the auxiliary rotary rod can be abutted in parallel.

Further, a first connecting structure for connecting a fan-shaped tent fabric is arranged at the other end of the base plate.

In order to connect the fan-shaped tent fabric to the base plate, the first connecting structure is arranged at the other end of the base plate according to the technical scheme. Specially, the first connecting structure includes a slot formed in the base plate and a channel where the tent fabric passes through is formed in the side surface of the slot.

Further, a distance from an axis of the front hinge shaft to a front end surface of the base plate is L1, a distance from an axis of the back hinge shaft to a front end surface of the base plate is L2, and L2 is greater than L1; the maximum width of the front rotary rod is L3, the maximum width of the back rotary rod is L4, and (L2-L1) is greater than or equal to 0.5*(L3+L4), and L1 is greater than 0.5*L3.

Further, the fixed seat includes a bottom plate fixedly connected to the base plate, connecting pieces are separately arranged on the upper and lower sides of the bottom plate, two ends of the front hinge shaft and the back hinge shaft are connected to the corresponding connecting pieces separately, and an avoidance notch is formed in the side, close to the back hinge shaft, of the bottom plate.

Further, the outer end portion of the rotary rod is connected to a connecting structure for connecting a supporting rod and is connected to the supporting rod through the connecting structure.

After the rotary rods are unfolded, weights of the rotary rods and the tent fabric are supported by the fixed seats and the fixed seats will deform after long time use. In order to prevent the condition, according to the technical scheme, the connecting structure is arranged on the outer end portion of each rotary rod to connect the supporting rod and the rotary rods and the tent fabric are supported by the supporting rods. Preferably, the supporting rod can be a telescopic supporting rod which can be adjusted in length.

Further, the connecting structure includes a mounting groove formed in a lower end surface of the rotary rod, and the upper end of the supporting rod is inserted into the mounting groove and is hinged to the rotary rod.

By forming the mounting groove, the supporting rod can rotate and embed, so that it is convenient to contain the supporting rod.

Or a slot is formed in the end portion of the rotary rod.

Further, the connecting piece is arranged between each rotary rod and the supporting rod, the connecting structure includes a splicing hole formed in the outer end portion of the rotary rod, a splicing hole is further formed in the upper end of the supporting rod, the connecting piece comprises a hinge portion located in the middle portion, splicing columns are separately arranged on two sides of the hinge portion, the splicing columns are hinged to the hinge portion and the two splicing columns can rotate relatively, and the splicing columns are inserted into the corresponding splicing holes.

Even further, the connecting portion comprises a hinge female end connected to one of the splicing columns and a hinge male end connected to the other splicing column, the hinge female end is provided with an avoidance notch matched with the hinge male end, the hinge female end and the hinge male end are provided with perforated holes, the connecting portion is provided with a hinge shaft, and one end of the hinge shaft penetrates through the perforated holes of the hinge female end and the hinge male end.

Preferably, a fixed head is arranged at one end of the hinge shaft and the other end of the hinge shaft is connected to a nut.

Preferably, the first connecting structure comprises a slot formed in the base plate and the upper end of the slot is opened.

Further, a mounting bracket is connected to a back end surface of the base plate and the mounting bracket is L-shaped.

A fan-shaped tent includes the fan-shaped tent skeleton and further includes a fan-shaped tent fabric, wherein one end of the fan-shaped tent fabric is connected to a connecting rod, the connecting rod is inserted into the slot, and the outer end portion of the fan-shaped tent fabric is connected to the outer end portions of all the rotary rods.

The disclosure has the beneficial effects that a plurality of rotary rods are arranged at one end of the base plate, such that the whole structure is similar to a fan skeleton. The fan-shaped tent skeleton is simple in integral structure and convenient to operate and use.

DESCRIPTION OF REFERENCE SIGNS

Figure 1:
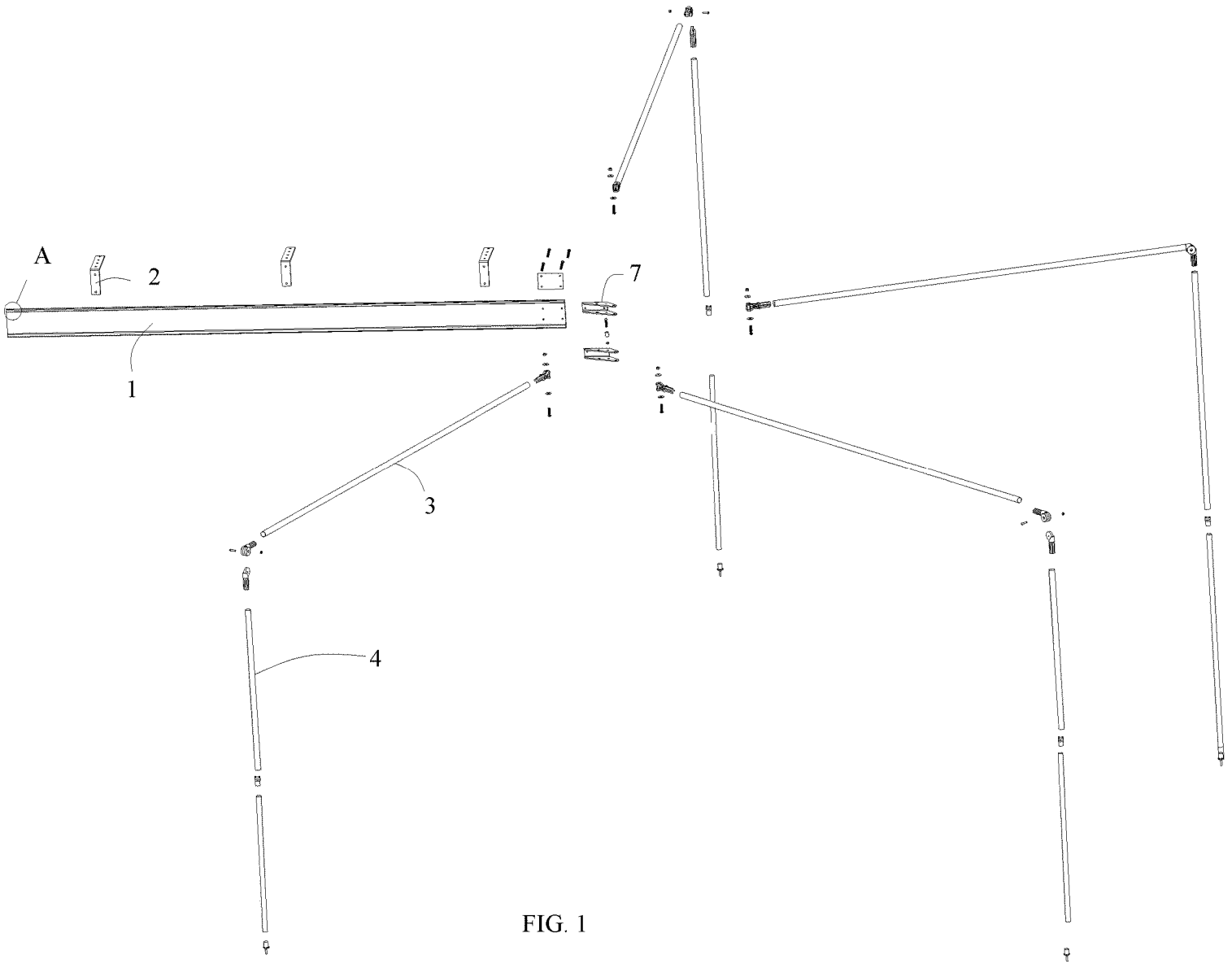
FIG. 1 is a breakdown structure schematic diagram of the fan-shaped tent skeleton of embodiment.
Figure 2:
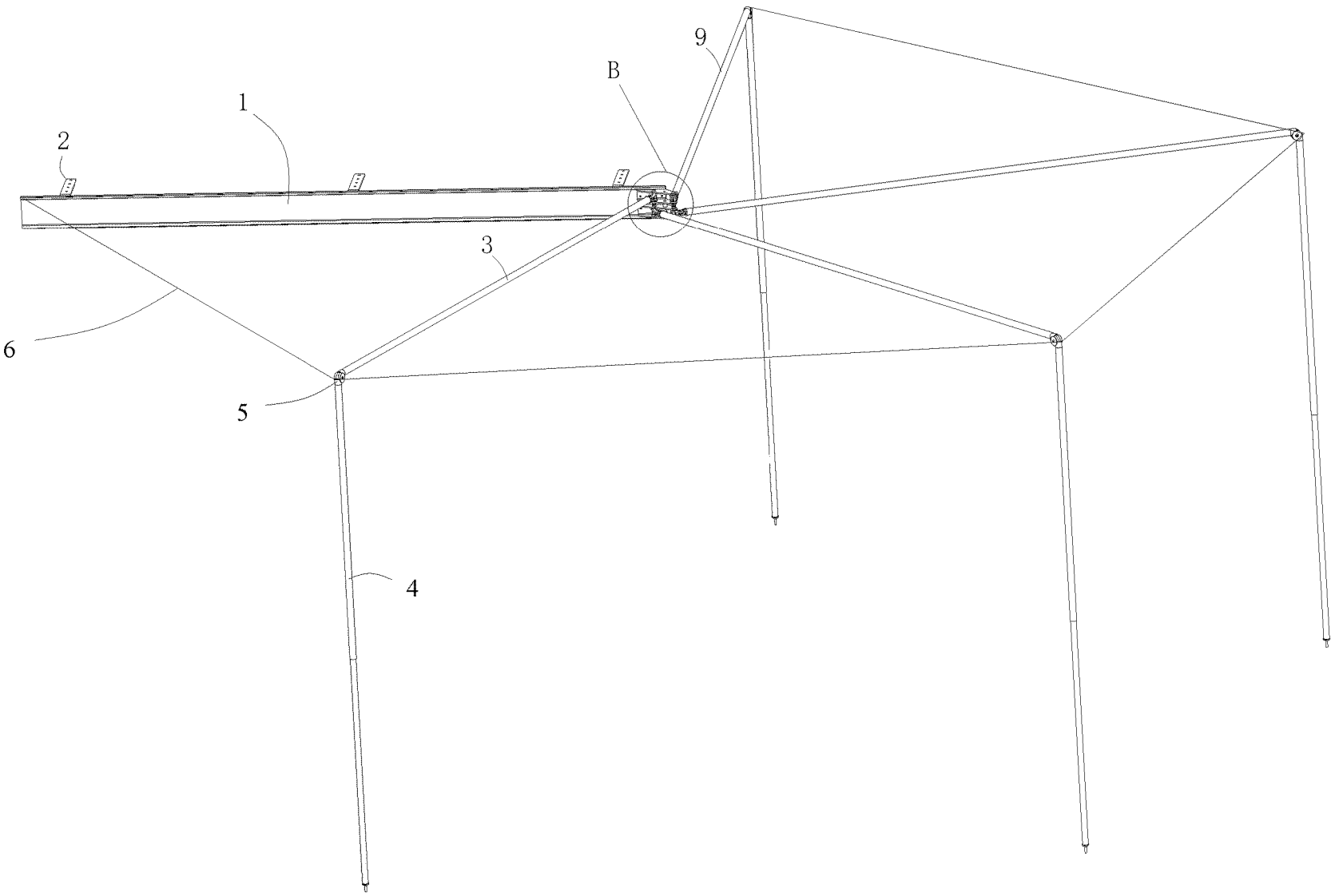
FIG. 2 is a structural schematic diagram of the fan-shaped tent skeleton of embodiment.
Figure 3:
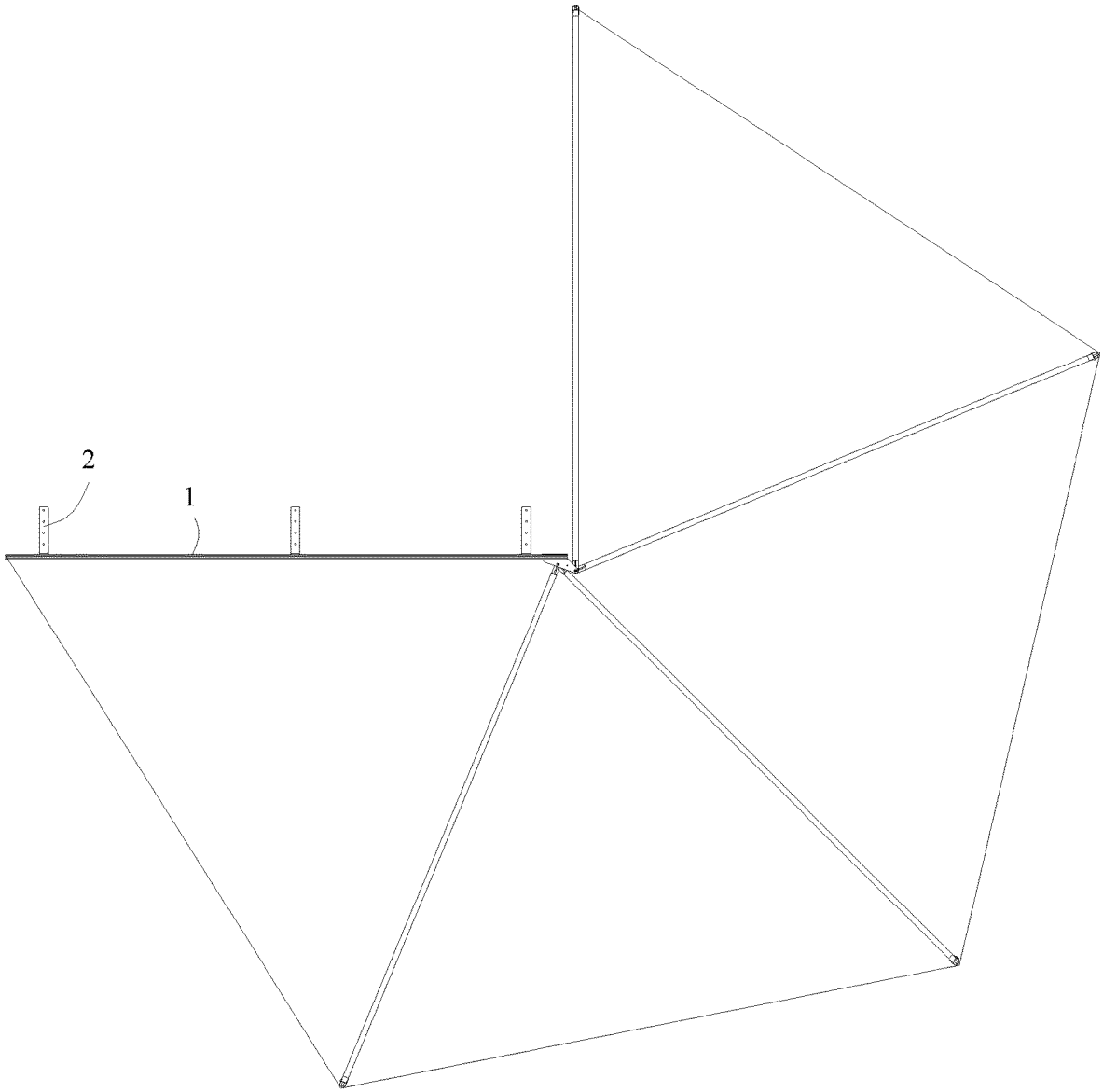
FIG. 3 is a schematic diagram of FIG. 2 from another perspective.
Figure 4:
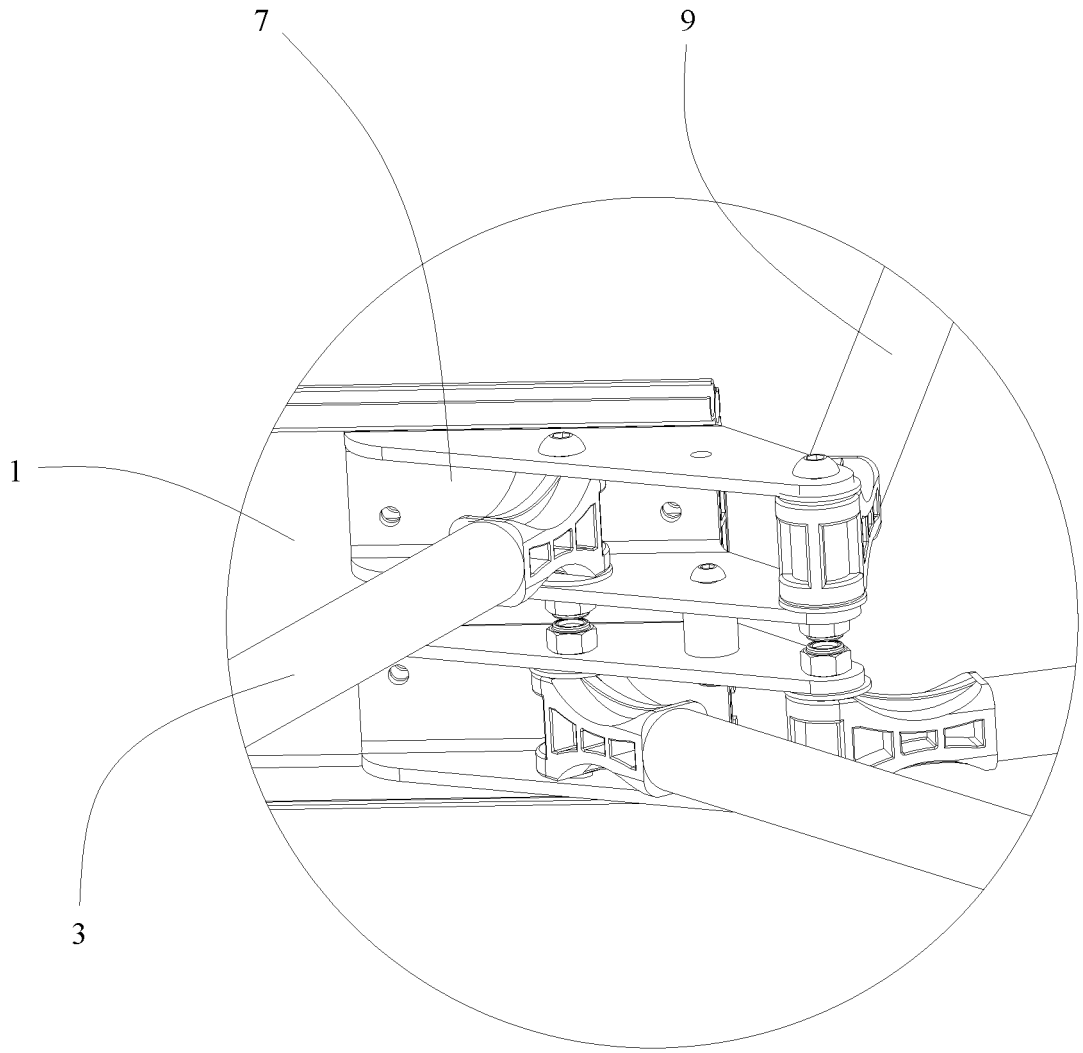
FIG. 4 is a schematic enlarged view of A in FIG. 1.

1—base plate. 2—mounting bracket, 3—front rotary rod, 4—supporting rod, 5—connecting piece, 6—fan-shaped tent fabric, 7—fixed seat, 8—slot, 9—back rotary rod, 51—splicing column, 52—hinge female end, 53—perforated hole, 54—hinge male end, 55—nut, 56—bolt, 71—bottom plate, 72—connecting piece, 73—avoidance notch

DETAILED DESCRIPTION

The disclosure is described below in details with reference to the accompanying drawings. As shown in FIG. 1 to FIG. 7, Embodiment I: with reference to FIG. 1 to FIG. 3, a fan-shaped tent skeleton includes a laterally arranged base plate 1, wherein rotary rod assemblies are arranged on the upper and lower sides of one end of the base plate 1, each of the rotary rod assemblies includes a fixed seat 7 fixed to the base plate 1, two rotary rods are hinged to the fixed seat 7, the two rotary rods are a front rotary rod 3 and a back rotary rod 9, the front rotary rod 3 and the back rotary rod 9 are connected to a front hinge shaft and a back hinge shaft and are connected to the fixed seat 7 through the front hinge shaft and the back hinge shaft, and a first connecting structure for connecting a fan-shaped tent fabric 6 is arranged at the other end of the base plate 1.

According to the technical scheme, when the fan-shaped tent fabric 6 works, the base plate 1 can be directly fixed to the vehicle body or other position. When it is needed to use the fan-shaped tent, each rotary rod rotates to the unfolded state relative to the fixed seat 7, a side edge of the fan-shaped tent fabric 6 is connected to the base plate 1 through the first connecting structure, the fan-shaped tent fabric 6 is then opened and erected above the rotary rods, and the other side edge of the fan-shaped tent fabric 6 is bounded to the rotary rod with the maximum rotating angle. In order to fix the fan-shaped tent fabric 6 conveniently, a plurality of bundling ropes are connected to the lower side of the fan-shaped tent fabric 6, and the bundling ropes are connected to the rotary rods. Therefore, the fan-shaped tent fabric 6 is fixed to the fan-shaped tent skeleton. When the fan-shaped tent skeleton is not used, the rotary rods are folded to be close to the base plate 1, and then the rotary rods are bounded to the base plate 1 through the ropes. In next use, the rotary rods are unfolded directly without fixing the fan-shaped tent fabric 6 again. The integral skeleton of the fan-shaped tent skeleton is similar to the skeleton of a fan. The fan-shaped tent skeleton is simple in integral structure and convenient to use, and is convenient to fold and unfold. Thus, in the using process, it is substantially unnecessary to mount and detach the skeleton. Second, besides being mounted on the vehicle body, the fan-shaped tent skeleton can be further mounted in other positions, for example a wall. The skeleton is mounted according to an actual demand.

Further, a distance from an axis of the front hinge shaft to a front end surface of the base plate 1 is L1, a distance from an axis of the back hinge shaft to a front end surface of the base plate 1 is L2, and L2 is greater than L1; the maximum width of the front rotary rod 3 is L3, the maximum width of the back rotary rod 9 is L4, and (L2−L1) is greater than or equal to 0.5*(L3+L4), and L1 is greater than 0.5*L3.

According to the technical scheme, it is convenient to fold the front rotary rod 3 and the back rotary rod 9 and to set the axis distance between the front hinge shaft and the back hinge shaft. Preferably, in order to fold the front rotary rod 3 to be close to the front end surface of the base plate 1, the separation distance is reduced, wherein L1=0.5*L3; second, the back rotary rod 9 which is folded is close to the end surface of the front rotary rod 3, wherein L2−L1=0.5*(L3+L4).

Figure 7:
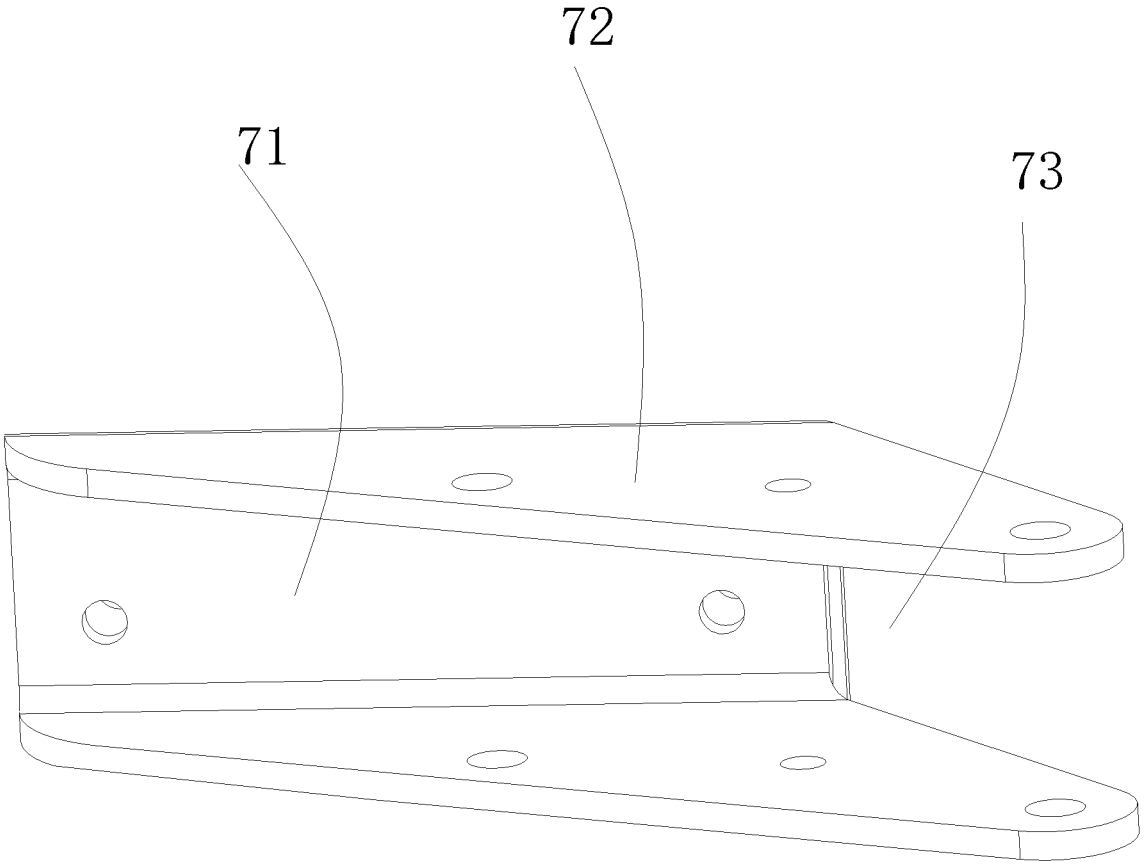
FIG. 7 is a structural schematic diagram of the fixed seat.

With reference to FIG. 7, further, the fixed seat 7 includes a bottom plate 71 fixedly connected to the base plate 1, connecting pieces 72 are separately arranged on the upper and lower sides of the bottom plate 71, two ends of the front hinge shaft and the back hinge shaft are connected to the corresponding connecting pieces 72 separately, and an avoidance notch 73 is formed in the side, close to the back hinge shaft, of the bottom plate 71.

In order to simplify the structure of the fixed seat 7, the fixed seat 7 can be arranged U-shaped and is connected to the base plate 1 through the middle bottom plate 71; the connecting pieces 72 on two sides of the fixed seat 7 extend outward, and the front hinge shaft and the back hinge shaft are fixed to corresponding positions. In view of relatively large rotating angle of the rotary rod connected to the back hinge shaft, an avoidance notch 73 is formed in the side, close to the back connecting shaft, on the bottom plate 71, so that it is convenient for the rotary rod to rotate at a relatively large angle.

Further, the outer end portion of the rotary rod is connected to a supporting rod 4.

In specific use, it is needed to support the fan-shaped tent fabric 6 by the rotary rods and the rotary rods themselves are in suspended states at one ends. In order to avoid gravity deformation, the supporting rod 4 is connected to the outer end portion of the rotary rod to support the rotary rod. Preferably, the supporting rod 4 is a supporting rod 4 adjustable in length.

Figure 5:
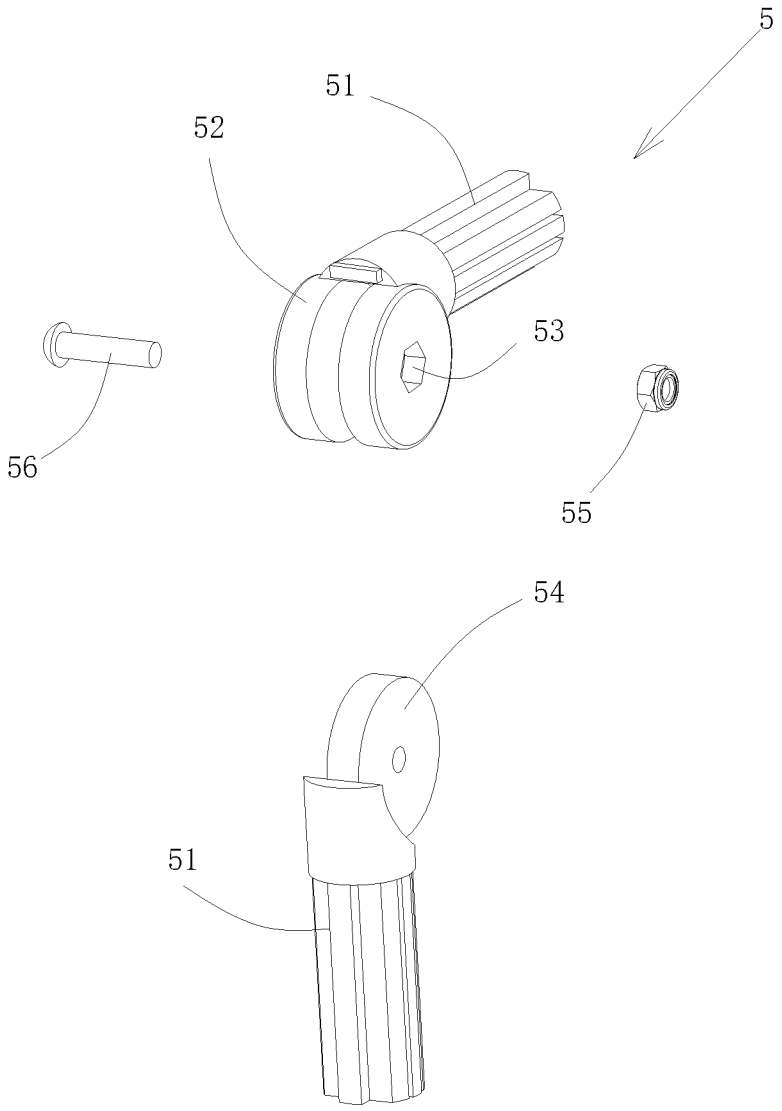
FIG. 5 is a breakdown schematic diagram of the connecting piece.

Further, the connecting piece 5 is arranged between each rotary rod and the supporting rod 4, a splicing hole is formed in the outer end portion of the rotary rod, a splicing hole is further formed in the upper end of the supporting rod 4, with reference to FIG. 5, the connecting piece 5 includes a hinge portion located in the middle portion, splicing columns 51 are separately arranged on two sides of the hinge portion, the splicing columns 51 are hinged to the hinge portion and the two splicing columns 51 can rotate relatively, and the splicing columns 51 are inserted into the corresponding splicing holes.

In specific design, the rotary rods and the supporting rods 4 can adopt hollow structures such as tubular bodies. The rotary rods and the supporting rods 4 are connected through the connecting pieces 5 and the splicing columns 51 at two ends of each connecting piece 5 can rotate relatively, such that the angle between the rotary rod and the supporting rod 4 can be adjusted according to terrain.

Even further, the connecting portion includes a hinge female end 52 connected to one of the splicing columns 51 and a hinge male end 54 connected to the other splicing column 51, the hinge female end 52 is provided with an avoidance notch matched with the hinge male end 54, the hinge female end 52 and the hinge male end 54 are provided with perforated holes 53, the connecting portion is provided with a hinge shaft, and one end of the hinge shaft penetrates through the perforated holes 53 of the hinge female end 52 and the hinge male end 54.

Preferably, a fixed head is arranged at one end of the hinge shaft and the other end of the hinge shaft is connected to a nut 55.

According to the technical scheme, in specific application, the avoidance notch is formed in the middle portion of the hinge female end 52, the hinge male end 54 is inserted into the avoidance notch, then the hinge female end 52 and the hinge male end 54 are connected by using a bolt 56, a screw of the bolt 56 is taken as a hinge shaft, one end of the bolt 56 is a bolt 56 head, the other end of the bolt 56 is connected to the nut 55, and relative rotation of the hinge female end 52 and the hinge male end 54 is controlled by means of a tightening degree of the nut 55. The hinge female end 52 is cylindrical, and the hinge male end 54 can be in a disc shape.

Figure 6:
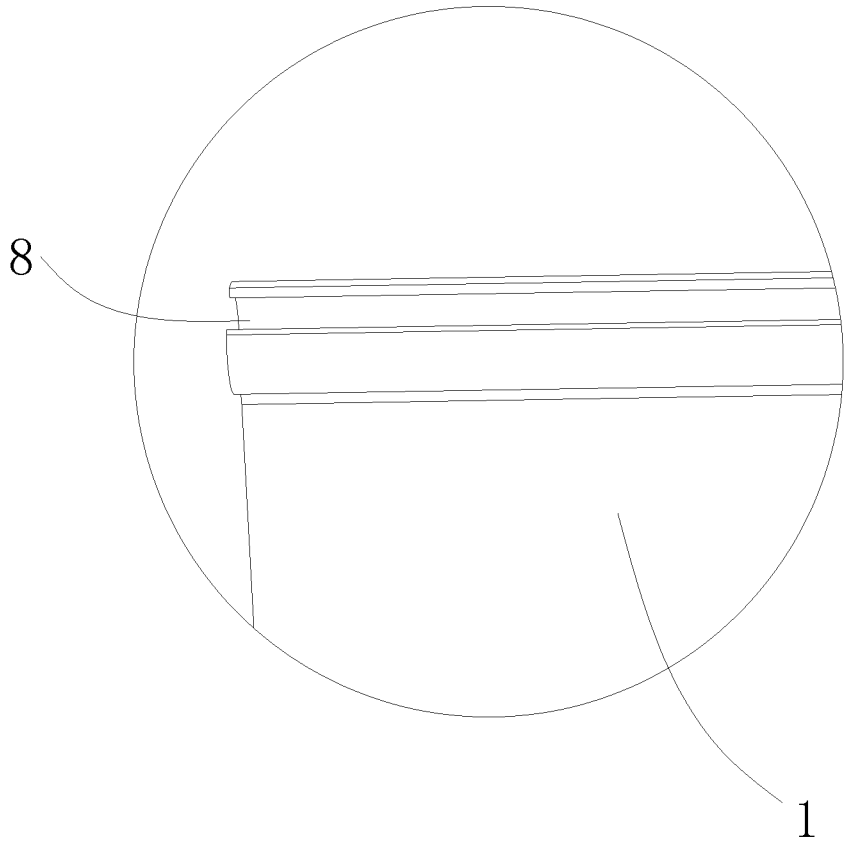
FIG. 6 is an enlarged schematic diagram of B in the FIG. 2.

With reference to FIG. 6, preferably, the first connecting structure includes a slot 8 formed in the base plate 1 and the upper end of the slot 8 is opened.

In order to connect the fan-shaped tent fabric 6 conveniently, the slot 8 is formed in the base plate 1. Preferably, the slot 8 opened in the upper end is formed in the upper end of the base plate 1. When the fan-shaped tent fabric 6 is mounted, the fan-shaped tent fabric 6 is fixed to one connecting rod first, then the connecting rod is inserted into the slot 8, and the fan-shaped tent fabric 6 passes through the opening, so that the fan-shaped tent fabric 6 is fixed.

Further, a mounting bracket 2 is connected to a back end surface of the base plate 1 and the mounting bracket 2 is L-shaped.

By arranging the mounting bracket 2, it is convenient to fix the base plate 1 to the vehicle body or other positions.

A fan-shaped tent includes the fan-shaped tent skeleton and further includes a fan-shaped tent fabric 6, wherein one end of the fan-shaped tent fabric 6 is connected to a connecting rod, the connecting rod is inserted into the slot 8, and the outer end portion of the fan-shaped tent fabric 6 is connected to the outer end portions of all the rotary rods.

The above mentioned is only the preferred embodiment of the disclosure. For those skilled in the art, variations will be made in specific embodiments and application range in terms of concept of the disclosure. The content in the description shall not be construed as limitations to the disclosure.

The invention claimed is:

1. A fan-shaped tent skeleton, comprising a base plate, wherein the base plate is arranged laterally, rotary rod assemblies are arranged on upper and lower sides of a first end of the base plate, each of the rotary rod assemblies comprises a fixed seat fixed to the base plate, two rotary rods are hinged to each of the fixed seats, wherein the two rotary rods are a front rotary rod and a back rotary rod, the front rotary rod and the back rotary rod are connected to a front hinge shaft and a back hinge shaft and the back rotary rod and the front rotary rod are connected to the fixed seat through the front hinge shaft and the back hinge shaft, and a first connecting structure for connecting a fan-shaped tent fabric is arranged at a second end of the base plate;

the fixed seat comprises a bottom plate fixedly connected to the base plate, connecting pieces are separately arranged on the upper and lower sides of the bottom plate, two ends of the front hinge shaft and the back hinge shaft are connected to the corresponding connecting pieces separately, and an avoidance notch is formed in a side, close to the back hinge shaft, of the bottom plate.

2. The fan-shaped tent skeleton according to claim 1, wherein a distance from an axis of the front hinge shaft to a front end surface of the base plate is L1, a distance from an axis of the back hinge shaft to the front end surface of the base plate is L2, L2 is greater than L1;

a maximum width of the front rotary rod is L3, a maximum width of the back rotary rod is L4, (L2−L1) is greater than or equal to 0.5*(L3+L4), and L1 is greater than 0.5*L3.

3. The fan-shaped tent skeleton according to claim 1, wherein an outer end portion of each of the front rotary rod and the back rotary rod is connected with a corresponding supporting rod.

4. The fan-shaped tent skeleton according to claim 3, wherein a connecting piece is arranged between each rotary rod and the corresponding supporting rod, splicing holes are formed in the outer end portion of each rotary rod and an upper end of the supporting rod, the connecting piece comprises a hinge portion located in the middle portion, two splicing columns are separately arranged on two sides of the hinge portion, the splicing columns are fixedly attached to the hinge portion, and the splicing columns are correspondingly inserted into the splicing holes.

5. The fan-shaped tent skeleton according to claim 4, wherein the hinge portion comprises a hinge female end connected to a first splicing column of the two splicing columns and a hinge male end connected to a second splicing column of the two splicing columns, the hinge female end is provided with an avoidance notch matched with the hinge male end, the hinge female end and the hinge male end are provided with perforated holes, the hinge portion is provided with a hinge shaft, and an end of the hinge shaft penetrates through the perforated holes of the hinge female end and the hinge male end.

6. The fan-shaped tent skeleton according to claim 5, characterized in that a fixed head is arranged at one end of the hinge shaft and the other end of the hinge shaft is connected to a nut.

7. The fan-shaped tent skeleton according to claim 1, wherein the first connecting structure comprises a slot formed in the base plate and an upper end of the slot is opened.

8. The fan-shaped tent skeleton according to claim 1, wherein a mounting bracket is connected to a back end surface of the base plate and the mounting bracket is L-shaped.

9. A fan-shaped tent, comprising a fan-shaped tent skeleton and a fan-shaped tent fabric;

wherein the fan-shaped tent skeleton comprises a base plate, wherein the base plate is arranged laterally, rotary rod assemblies are arranged on upper and lower sides of a first end of the base plate, each of the rotary rod assemblies comprises a fixed seat fixed to the base plate, two rotary rods are hinged to each of the fixed seats, wherein the two rotary rods are a front rotary rod and a back rotary rod, the front rotary rod and the back rotary rod are connected to a front hinge shaft and a back hinge shaft and the back rotary rod and the front rotary rod are connected to the fixed seat through the front hinge shaft and the back hinge shaft, and a first connecting structure for connecting the fan-shaped tent fabric is arranged at a second end of the base plate, wherein the first connecting structure comprises a slot formed in the base plate and an upper end of the slot is opened;

the fixed seat comprises a bottom plate fixedly connected to the base plate, connecting pieces are separately arranged on the upper and lower sides of the bottom plate, two ends of the front hinge shaft and the back hinge shaft are connected to the corresponding connecting pieces separately, and an avoidance notch is formed in a side, close to the back hinge shaft, of the bottom plate;

wherein a first end of the fan-shaped tent fabric is connected to a connecting rod, the connecting rod is inserted into the slot, and an outer end portion of the fan-shaped tent fabric is connected to outer end portions of all the rotary rods.

* * * * *